US009650114B1

(12) United States Patent
Maresh

(10) Patent No.: US 9,650,114 B1
(45) Date of Patent: May 16, 2017

(54) MODULAR FLOATATION BOARD

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 14/732,710

(22) Filed: Jun. 6, 2015

Related U.S. Application Data

(60) Provisional application No. 62/124,365, filed on Dec. 17, 2014.

(51) Int. Cl.
*B63B 7/02* (2006.01)
*B63B 35/79* (2006.01)

(52) U.S. Cl.
CPC ..... *B63B 35/7906* (2013.01)

(58) Field of Classification Search
CPC ..... B63B 7/02; B63B 35/7916
See application file for complete search history.

(56) References Cited

U.S. PATENT DOCUMENTS 3,137,872 A 6/1964 Edwards et al.
3,409,920 A 11/1968 Brownley
3,983,830 A 10/1976 Morgan
3,996,868 A 12/1976 Schagen
4,928,619 A 5/1990 Cochran
5,711,692 A 1/1998 Pope
6,860,221 B1 3/2005 Henderson
7,021,234 B1 4/2006 Belyeu
7,347,755 B1 3/2008 Katzfey
7,390,234 B2 6/2008 Peach
7,587,986 B2 9/2009 Neidert et al.
8,123,580 B1 * 2/2012 Meyerhoffer ..... B63B 35/7916 441/74
8,272,907 B2 9/2012 Lindstrom
8,469,756 B2 6/2013 Becker
2006/0246795 A1 * 11/2006 Meyerhoffer ..... B63B 35/7916 441/74
2010/0326345 A1 12/2010 Ohman et al.
2011/0207376 A1 * 8/2011 Lindstrom ..... B63B 35/7916 441/74
2012/0216389 A1 * 8/2012 Becker ..... B63B 35/7916 29/525.01
2013/0029547 A1 1/2013 Suzuki
2014/0273679 A1 * 9/2014 Ramelot ..... B63B 35/7913 441/66

* cited by examiner

*Primary Examiner* — Stephen Avila
(74) *Attorney, Agent, or Firm* — Nick A Nichols, Jr.

(57) ABSTRACT

A modular floatation board may have predetermined flexibility or rigidity characteristics where the longitudinal bending moment of the assembled board is generally transmitted in a distributed manner from a nose module to a tail module through an intermediate module. The modules may be coupled together by an interface connection established between the intermediate module and the nose and tail modules. A tensioning member may compress the modules in longitudinal alignment and prevent the modules of the assembled board from separating.

12 Claims, 9 Drawing Sheets

MODULAR FLOATATION BOARD

CROSS-REFERENCE TO RELATED APPLICATION

This application claims the benefit of U.S. Provisional Application Ser. No. 62/124,365, filed Dec. 17, 2014, which application is incorporated herein by reference in its entirety.

BACKGROUND

The present invention relates to floatation boards, such as surf boards, paddle boards, and the like, and more particularly to a modular floatation board that may be disassembled for convenient transport and subsequently reassembled for use while maintaining a predetermined bending modulus. The bending modulus of the modular floatation board may be designed for a range from highly flexible to highly rigid. In the latter case, board rigidity may be designed to be equal or greater than typical solid one pierce board designs.

It is generally well known that currently available modular and/or inflatable boards are not rigid and flex or sink in the middle portion of the board, and hence the overall performance of such boards is generally unsatisfactory in calm waters. A rigid board is generally more desirable for use on flat water because it will track better and glide faster than a flexible board. A rigid board is also easier to balance on and less wobbly or unstable on surf and/or choppy waters. Rigid boards are generally preferred for use on lakes and the like where the water is relatively calm. On rough water and/or choppy water a rigid board may be less preferred because the board performance may feel "bumpy."

Generally speaking, in rough water and/or waves a flexible board may provide better board performance because it may flex and absorb the impact from choppy waves as well as bend and flex to fit on a wave. On a flexible board, the natural rocker of a board changes during right/left rail to rail transitions. The rail to rail transition gives a board more rocker while facilitating turns resulting in a recoil snap and spring out of every turn, generally referred to in some circles as "flex and snap" energy. A rigid board generally makes turning in rough water more difficult, however, other factors in addition to the rocker or rocker line, such as rail shape, bottom profile, fin setup and volume size also affect board performance.

The prior art includes various modular or collapsible/foldable floatation board designs which provide for efficient transport or convenient carrying packages. The carrying package of such modular boards is generally minimized both in the overall length and the number of modular components to be transported. However, upon reassembly of such boards, generally weak regions exist that limit the load bearing capacity of the boards and/or create local regions in the boards subject to high shear stresses, and therefore flexing and/or bending at those regions may be significant.

Therefore, a need exists for a modular floatation board designed to flex a predetermined amount at a given load capacity, wherein the board's longitudinal bending moment is generally transmitted in a distributed manner from the front to rear of the board through a center module, rather than transmitting the bending moment in a concentrated localized manner, as is typically found in prior art modular boards.

SUMMARY

A modular floatation board may include designed flexibility and/or rigidity characteristics where the longitudinal bending force of the assembled board is generally transmitted in a distributed manner from a nose module to a tail module through an intermediate module. A tensioning member may releasably couple the modules together in longitudinal alignment. A peripheral interface connection securing the intermediate module to the nose and tail modules may provide for transmittal of longitudinal bending forces over a non-localized area of the modular floatation board.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
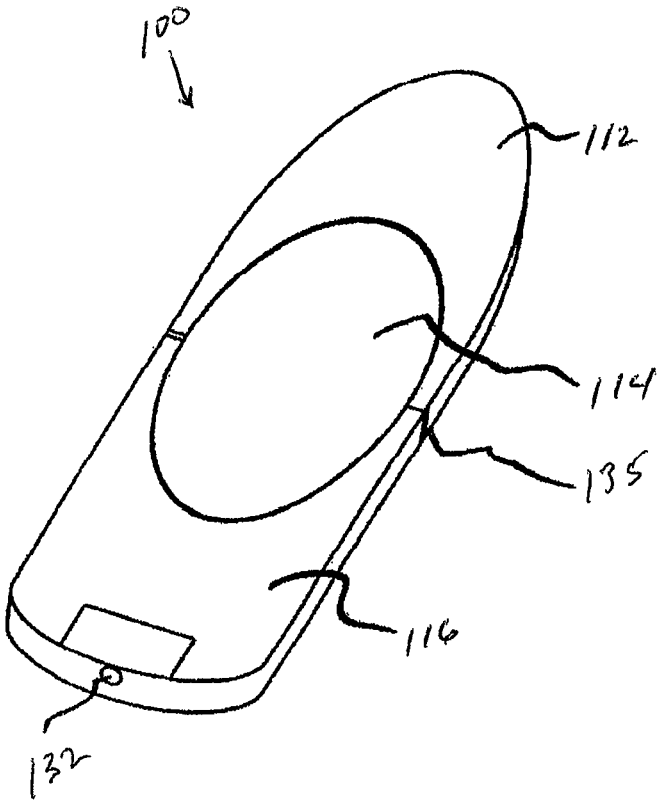
FIG. 1 is a perspective view of a modular floatation board.

Referring first to FIG. 1, a modular floatation board is generally identified by the reference numeral 100. The board 100 may include a front or nose module 112, a central or intermediate module 114 and a rear or tail module 116. The lengths of the modules 112, 114 and 116 may be substantially the equal however the assembled length of the floatation board 100 may not equal the sum of the lengths of the modules 112, 114, and 116. For example, each module 112, 114 and 116 may have a length of five feet but the assembled length of the floatation board 100 may be ten feet. In the above example, the assembled length of the floatation board equals the sum of the lengths of the modules 112 and 116.

Figure 2:
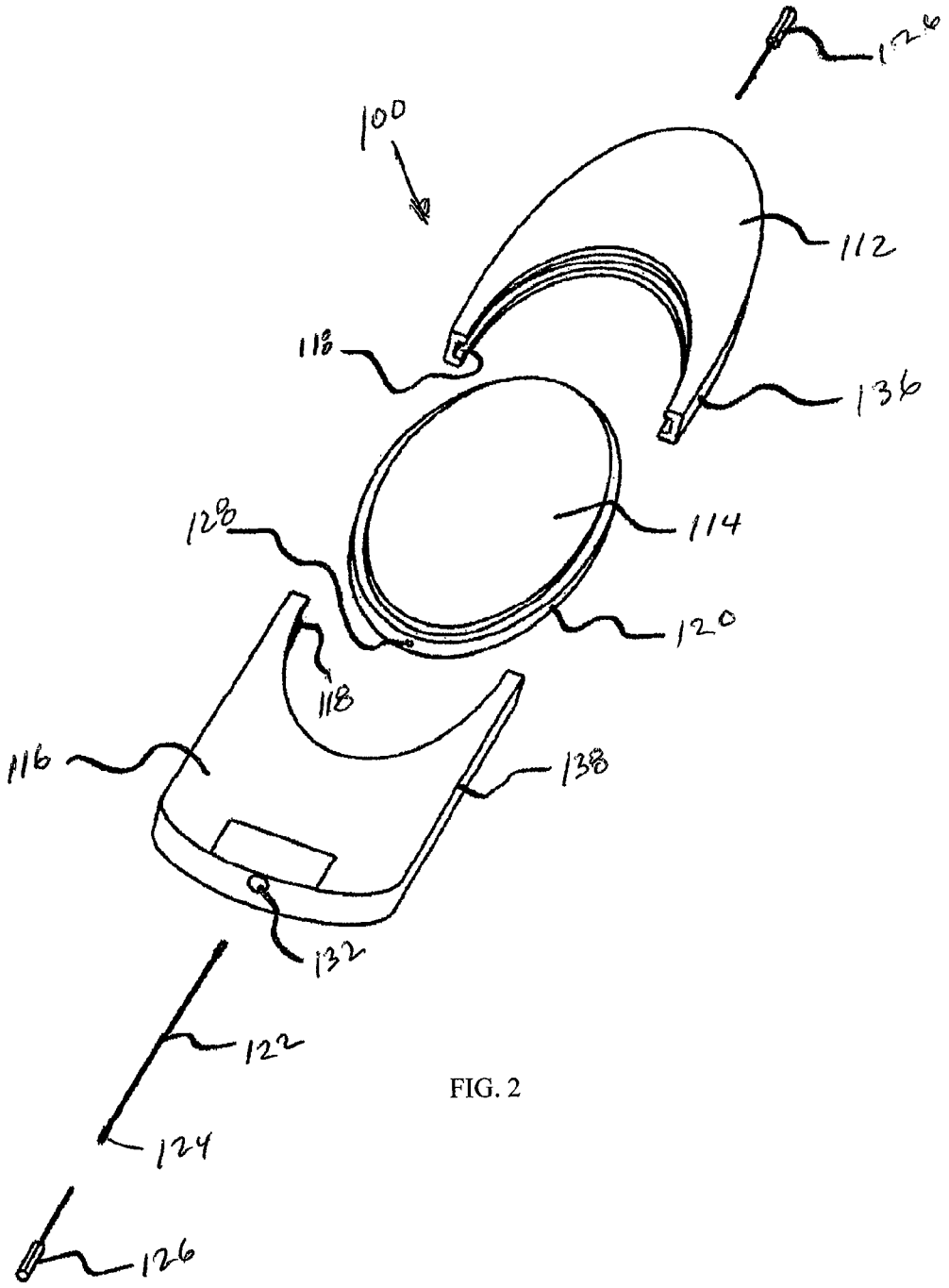
FIG. 2 is an exploded perspective view of the modular floatation board shown in FIG. 1.

Referring now to FIG. 2, the nose module 112 may include a semi-circumferential groove 118 established on a horizontal plane and generally drafted longitudinally open rearward toward a central region of the assembled board 100. The tail module 116 may likewise include a semi-circumferential groove 118 established on a horizontal plane and generally drafted longitudinally open forward toward a central region of the assembled board 100. The intermediate module 114 may include a circumferential rib 120 projecting outwardly from the side edge of the intermediate module 114. The rib 120 is sized to fit in the grooves 118 of the modules 112, 116 to form a tongue and groove joint between the intermediate module 114 and the nose and tail modules 112 and 116.

Figure 3:
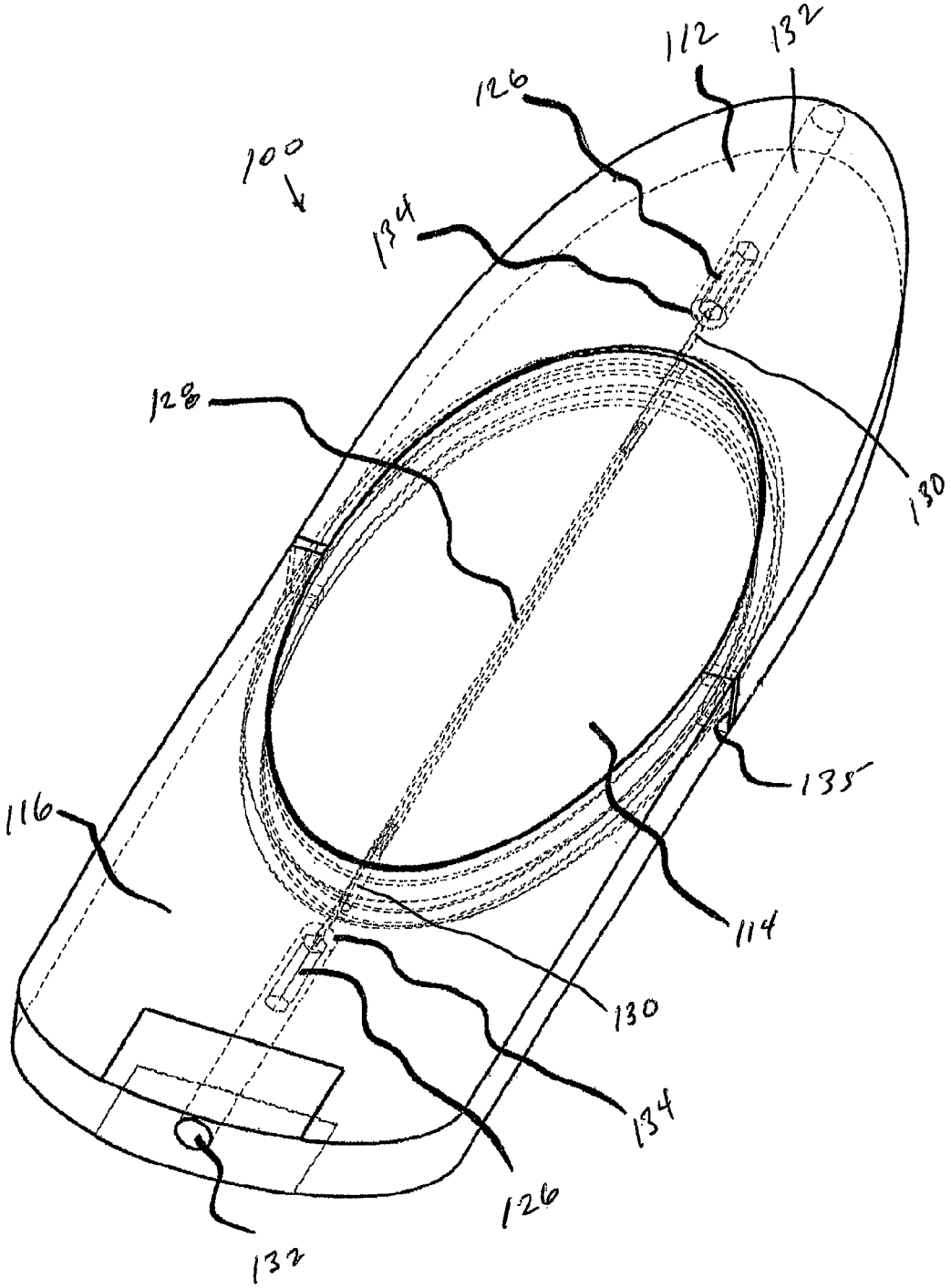
FIG. 3 is perspective of the modular floatation board shown in FIG. 1 with hidden lines shown.

The modules 112, 114 and 116 of the assembled floatation board 100 may be locked together by one or more longitudinal tensioning assemblies. For purposes of illustration, a tensioning assembly installed along the longitudinal center axis of the floatation board is shown in FIGS. 1-3. The tensioning assembly may include a threaded rod 122, coupling nuts 124 connected to the distal ends of the rod 122 and tightening nuts 126. The intermediate module 114 may include a central longitudinal passageway 128. The nose module 114 and tail module 116 may each include a borehole 130, shown in FIG. 3, and a coaxial counterbore 132 extending inwardly from the distal ends of the nose module 112 and tail module 116. The counterbores 132 terminate at a flat inwardly extending circumferential shoulder 134. The borehole 130 and counterbore 132 are in longitudinal alignment with the passageway 128 extending through the intermediate module 114. The tensioning assembly may be installed by connecting a tightening nut 126 to a distal end of the rod 128 and inserting the rod 122 through the counterbore 132 and borehole 130 of, for example, the nose module 112 into the passageway 128 of the intermediate module 114. A second tightening nut 126 may then be inserted through the counterbore 132 and borehole 130 in the tail module 116 and connected to the opposite distal end of the rod 128. The intermediate module 114 may be longitudinally compressed between the nose module 112 and tail module 114 by tightening the tightening nuts 126 to form the tongue and groove connection joining the intermediate module 114 to the nose and tail modules 112, 116.

Referring again to FIG. 1, although the board rail of the board 100 is discontinuous at the juncture 135 of the nose module rail 136 and tail module rail 138, the circumferential rib 120 of the intermediate module 114 is continuous, thereby establishing a continuous tongue and groove joint between the intermediate module 114 and the nose and tail modules 112 and 116. The tongue and groove connection distributes the shear stresses created by loads counteracting the buoyancy forces acting on the board over the continuous tongue and groove interface rather than concentrating the shear forces at discreet points of connection typical of prior art board designs.

The intermediate module 114 is effectively an independent member having a shear support structure to maintain a predetermined board rigidity. For most longitudinal cross sections of the assembled floatation board 100, the board rails 136 and 138 together with the circumferential rib 120 of the intermediate module 114 act together to counter all bending moments, both lateral and longitudinal. In this respect the floatation board 100 is generally twice as strong in bending resistance as a standard one piece non-modular board because generally double the number of vertical shear walls are provided. Furthermore, any weakness in bending resistance in the floatation board 100 at any given cross section may be controlled during manufacture of the intermediate module 114 by thickening and/or strengthening the circumferential rib 120 at any given cross section as may be required to maximize the stiffness values for the floatation board 100. For example, but not by way of limitation, strengthening of the intermediate module 114 may be accomplished when rotomolding or blow molding the intermediate module 114. The plastic solidifies after molding to form significant structure at rib 120 and/or at any desired region, such as the region where the board rails 136 and 138 meet and are discontinuous. The intermediate module 114 may generally be designed to be the strongest module of the assembled floatation board 100 because the central region of the floatation board 100 experiences the greatest bending moment. The intermediate module 114 may be designed to have bending strength that surpasses the bending strength of a standard board while having a manageable size and weight for convenient transport.

Figure 4:
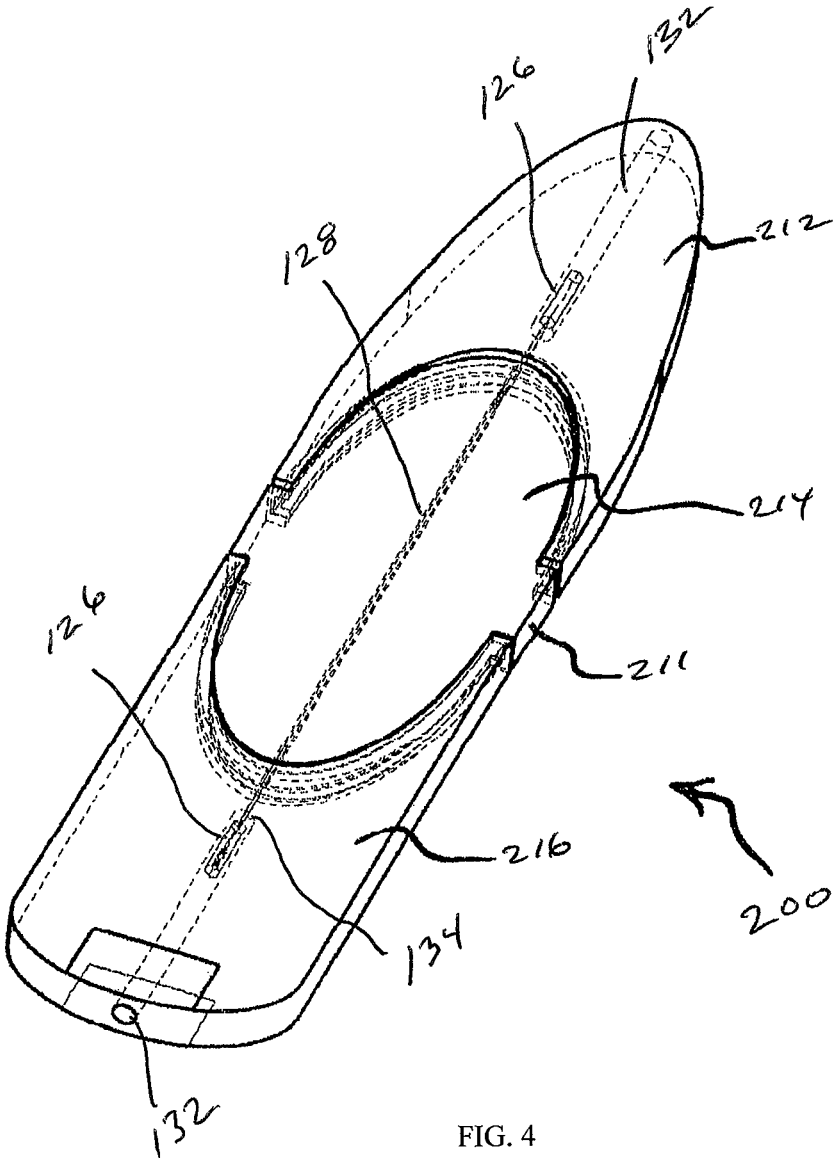
FIG. 4 is a perspective view of a second embodiment of a modular floatation board.
Figure 5:
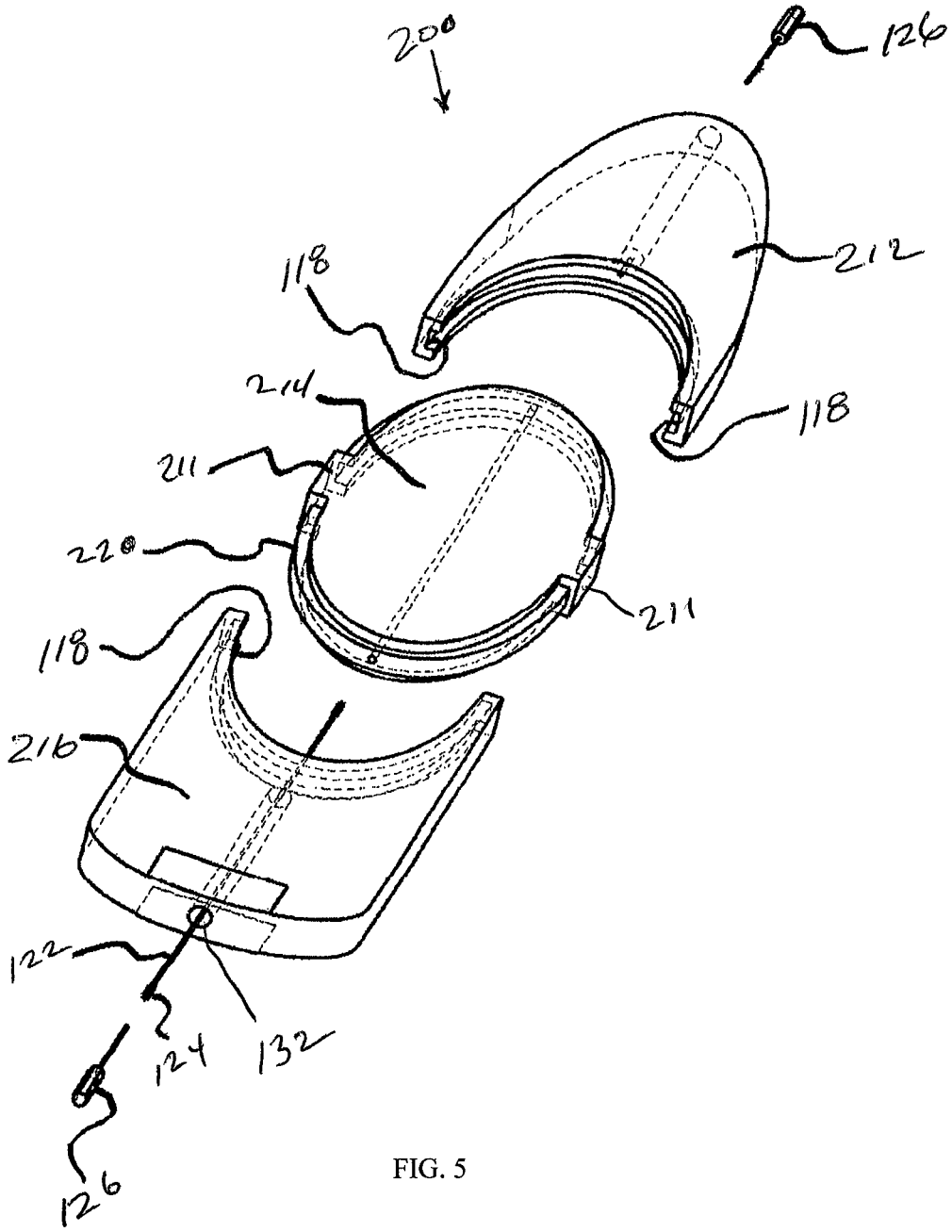
FIG. 5 is an exploded perspective view of the modular floatation board shown in FIG. 4.

Referring now to FIGS. 4 and 5, a second embodiment of a modular floatation board is generally identified by the reference numeral 200. As indicated by the use of common reference numeral, the modular board 200 is similar to the modular board 100 described above. The width of the modular board 200 is substantially the same as the modular board 100 but its length is greater. The nose module 212, intermediate module 214 and tail module 216 may be, for example, six feet in length, but the assembled length of the modular board 200 may be twelve feet. The length of intermediate module 214 may be extended in the vicinity of the central region of the rail 211 while maintaining the same board width. The nose module 212 and tail module 216 may be lengthened a similar amount. The intermediate module 214 may include a circumferential rib 220 projecting outwardly from the side edge of the intermediate module 114. The rib 220 may comprise two segments that terminate at the opposite ends of the rail 211. Upon assembly, the rib 220 is received in the semi-circumferential grooves 118 of the nose module 212 and rear module 216. Installation of the tensioning assembly compresses the modular components together to form a tongue and groove connection as described above with reference to the modular board 100. The modular board 200 may be designed to predetermined parameters over a range of board flexibility, as desired.

Figure 6:
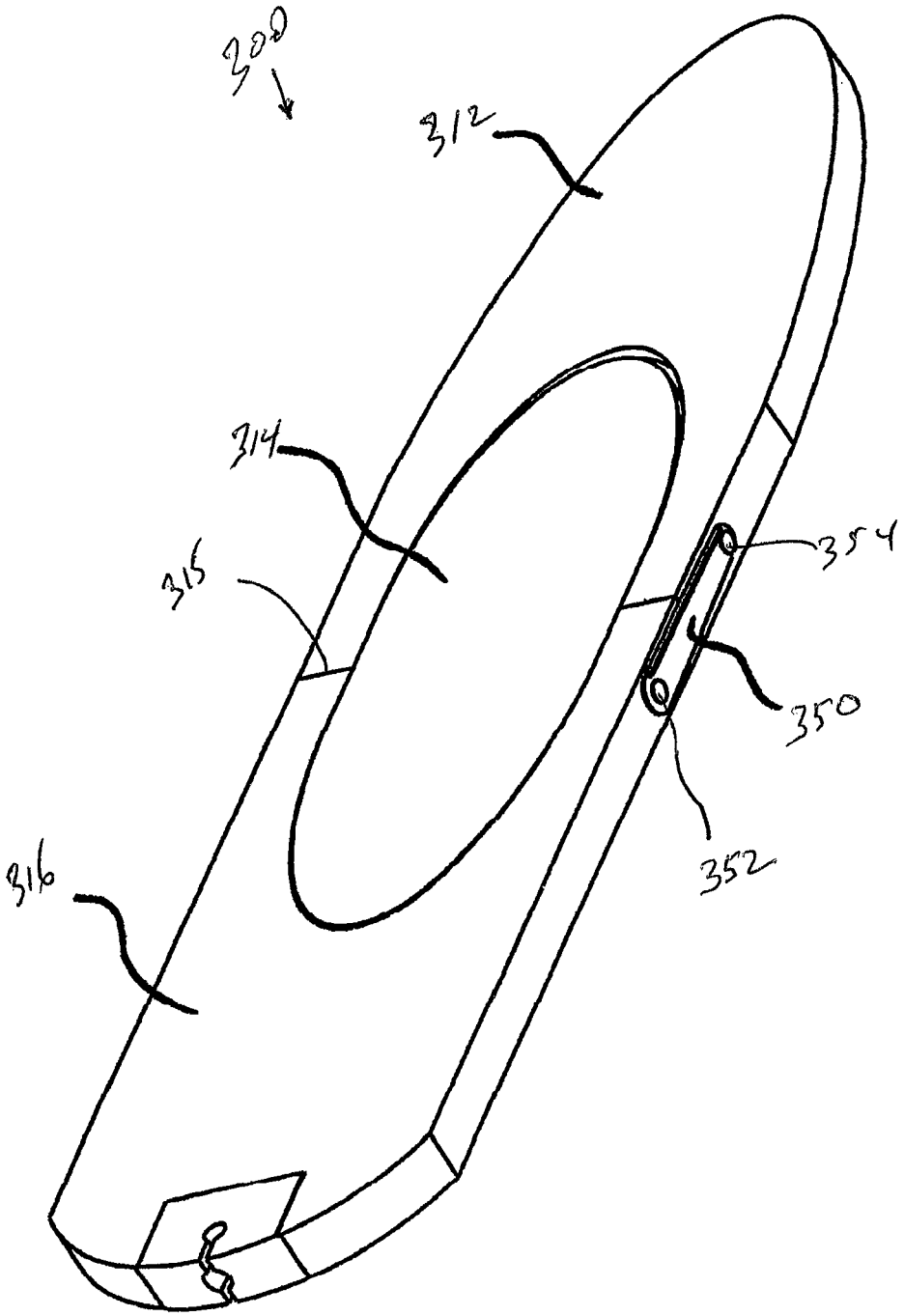
FIG. 6 is a perspective view of a third embodiment of a modular floatation board.
Figure 7:
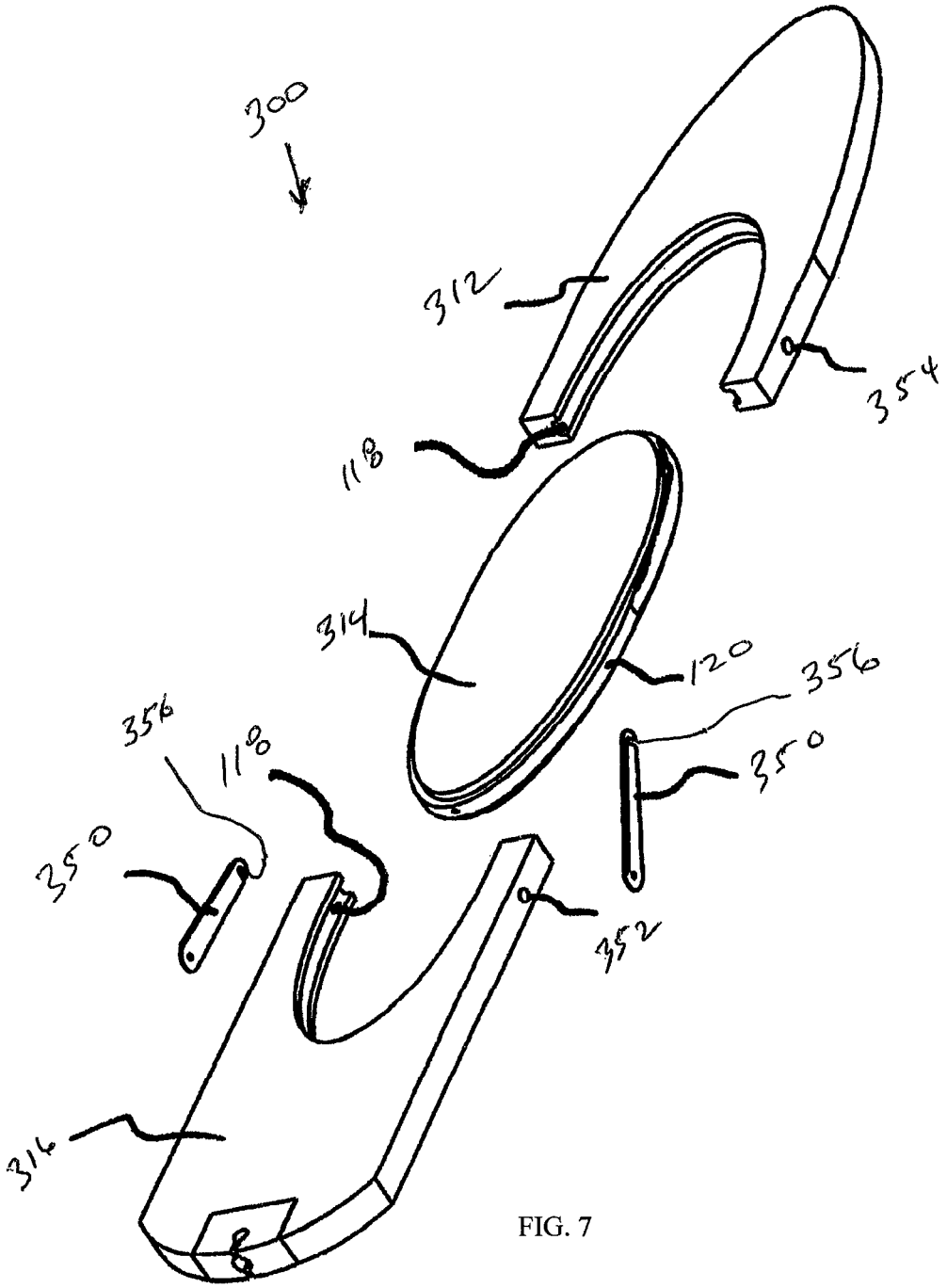
FIG. 7 is an exploded perspective view of the modular floatation board shown in FIG. 6.

Referring now to FIGS. 6 and 7, a third embodiment of a modular floatation board is generally identified by the reference numeral 300. As indicated by the use of common reference numerals, the modular board 300 is substantially similar to the modular boards 100, 200 described above. It will be observed that the longitudinal dimension of the intermediate module 314 of the modular board 300 is substantially greater than the transverse dimension. The shape of the intermediate module 314 may be designed to deliver the desired flexibility of a modular board.

The intermediate module 314 may be provided with a circumferential rib 120 sized to be received in the grooves 118 of the nose module 312 and the tail module 316. A latch 350 may be rotatably connected to a shaft or pin 352 fixedly secured to the board rail 138 of the tail module 316. A shaft or pin 354 is similarly fixedly secured to the board rail 136 of the nose module 312. The pins 352, 354 are fixed on opposite sides of the point of abutment 315 between the nose module 312 and tail module 316. The latch 350 may be provided with an open hook or catch 356 for engagement with the pin 354 to prevent separation of the nose module 312 from the tail module 316. The primary forces acting on the latch 350 are tensile forces. Bending forces are transmitted between the nose module 312 and tail module 316 through the tongue and groove interface of the intermediate module 314 with the nose module 312 and tail module 316.

Figure 8:
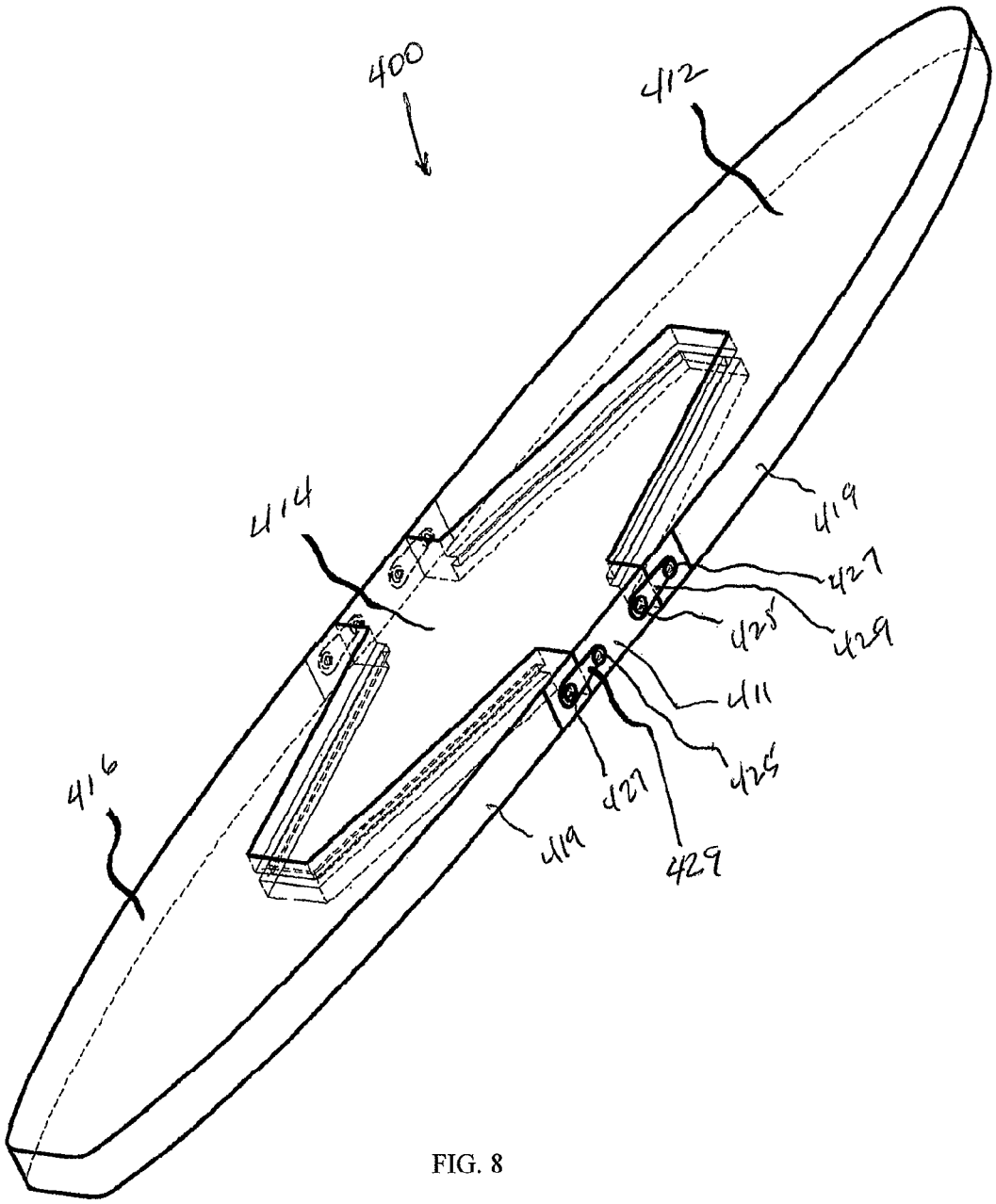
FIG. 8 is a perspective of a fourth embodiment of a modular floatation board.
Figure 9:
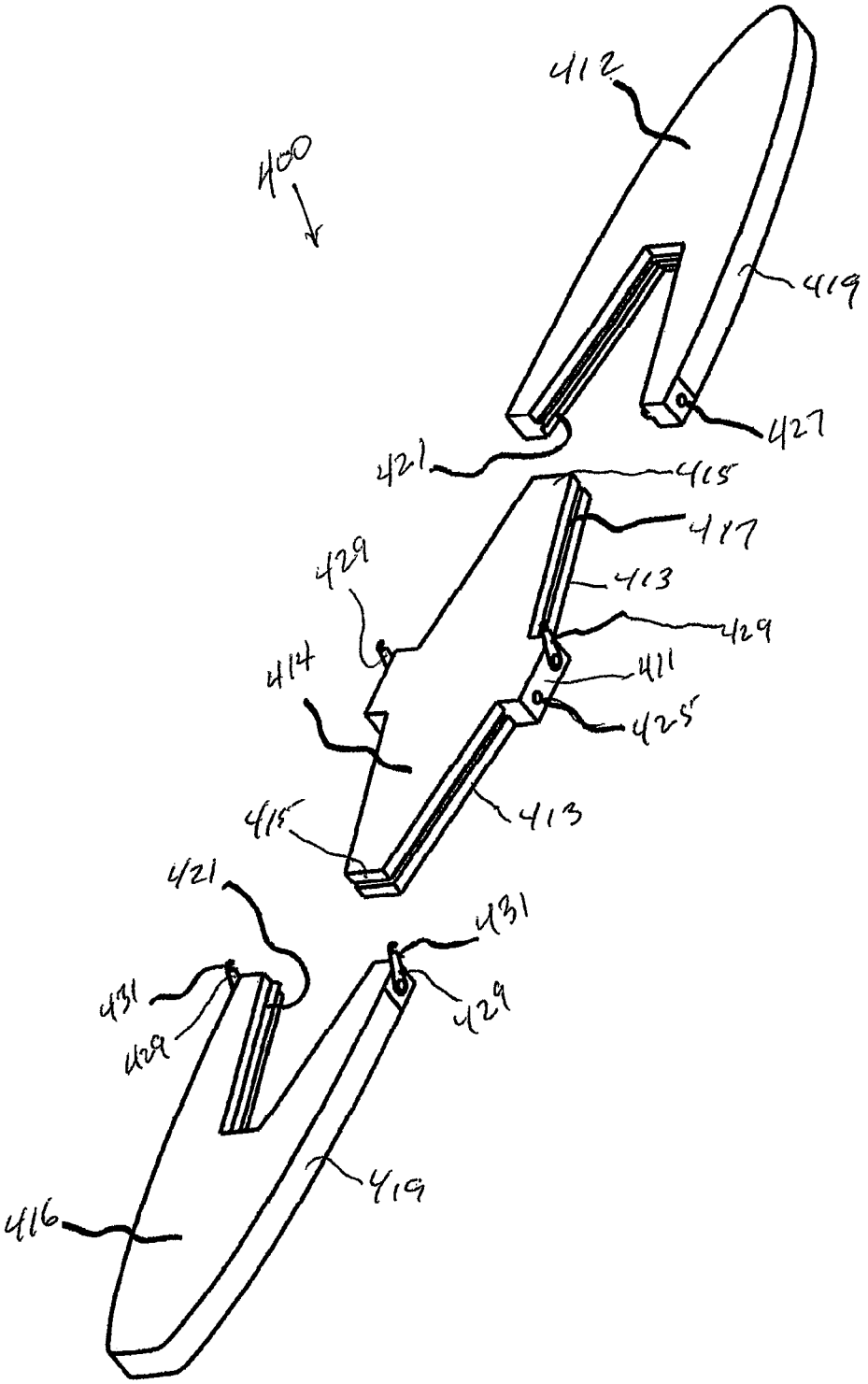
FIG. 9 is an exploded perspective view of the modular floatation board shown in FIG. 8.

Referring now to FIGS. 8 and 9, a fourth embodiment of a modular floatation board is generally identified by the reference numeral 400. The modular board 400 is similar to the modular boards 200, 300 described above with the exception that the intermediate module 414 of the modular board 400 includes an elongated longitudinal portion. The intermediate module 414 includes a transverse central portion bound by rails 411 at opposite sides thereof. The rails 411 are configured to match the rail 419 of the modular board 400 when the modules are assembled. Linear side edges 413 extend outwardly form opposite sides of the rails 411 and terminate at transverse edges 415. The intermediate module 414 may include a continuous groove 417 extending from the opposite sides of the rails 411 along the lengths of the side edges 413, 415. The nose module 412 and the tail module 416 each include a rib 421 established on a horizontal plane and generally drafted longitudinally open toward a central region of the assembled board 400. The ribs 421 are configured for mating engagement with the groove 417 to form a tongue and groove connection between the intermediate module 414 and the nose and tail modules 412, 416.

The modules of the assembled modular board 400 may be held together by a pair of latch fasteners anchored to the rails 411 and 419. A pair of spaced apart anchor posts 425 may be fixedly secure to the rails 411. Anchor posts 427 may be fixedly secured to the rail 419 proximate the distal ends of the nose module 412 and the tail module 416. The anchor posts 425, 427 are longitudinally aligned. A latch lever 429 pivotally connected to the anchor posts 427 may include a slot or catch 431 to engage the anchor posts 425 to hold the modules 412, 414, 416 together. Other locking configuration may be employed to prevent separation of the assembled modular board 400. For example, but not by way of limitation, the latch lever 429 may be pivotally connected to the anchor posts 425 and slot 431 latch to the anchor posts 427.

The elongated configuration of the intermediate module 414 may maximize the tongue and groove connection between the intermediate module 414 and the nose and tail modules 412, 416. and thereby provide a substantially rigid board. The tongue and groove contact area between the intermediate module and the nose and tail modules may be increased or decreased to change the degree of flexibility or rigidity of the modular floatation boards described herein.

While several embodiments of the invention has been shown and described, other embodiments of the invention may be devised without departing from the basic scope thereof, and the scope thereof is determined by the claims which follow.

The invention claimed is:

1. A modular floatation board, comprising:

a) a nose module having a longitudinal axis;

b) a tail module having a longitudinal axis;

c) an intermediate module having a longitudinal axis, wherein said intermediate module is disposed between said nose module and said tail module, said intermediate module including a longitudinal dimension and a transverse dimension, wherein said longitudinal dimension is greater than said transverse dimension;

d) said intermediate module including a peripheral interface surface cooperatively engaging said nose module and said tail module forming a peripheral interface joint coupling said nose module and said tail module to said intermediate module; and e) a tensioning member releasably coupling said intermediate module to said nose module and said tail module in longitudinal alignment.

2. The modular floatation board of claim 1 wherein said peripheral interface joint defines a continuous joint connecting said nose module, said intermediate module and said tail module in serial longitudinal alignment.

3. The modular floatation board of claim 2 wherein said continuous joint is a tongue and groove joint.

4. The modular floatation board of claim 1 wherein said intermediate module includes a longitudinal axial passageway, each said nose module and said tail module including a borehole in longitudinal axial alignment with said axial passageway, said tensioning member extending through each said borehole and said axial passageway operably connected for applying a compressive force joining said intermediate module to said nose module and said tail module.

5. The modular floatation board of claim 1 wherein said nose module includes a first axial dimension and said tail module includes a second axial dimension, and wherein an assembled floatation board includes a longitudinal length defined by the sum of said first and second axial dimension.

6. The modular floatation board of claim 1 wherein said nose module includes a first board rail and said tail module includes a second board rail, wherein said first and second board rail define a discontinuous floatation board rail having first and second gaps, said intermediate module including first and second board rail segments adapted for receipt in said first and second gaps, respectively.

7. The modular floatation board of claim 1 wherein said tensioning member comprises at least two latch members pivotally connected to one of said nose module and said tail module, said latch members being rotatable for latching engagement with a respective latch post fixedly secured to the other of said nose module and said tail module.

8. The modular floatation board of claim 1 wherein said intermediate module includes a plurality of linear interface segments defining said peripheral interface surface of said intermediate module.

9. The modular floatation board of claim 1 wherein said peripheral interface surface is formed by a circumferential rib projecting radially outwardly from said intermediate module.

10. The modular floatation board of claim 9 wherein said nose module and said tail include a semi-circumferential groove for interface connection with said circumferential rib of said intermediate module.

11. A modular floatation board, comprising:

a) a forward module, a center module, and a rear module;

b) said center module including a longitudinal dimension and a transverse dimension, wherein said longitudinal dimension is greater than said transverse dimension;

c) said center module including a peripheral interface surface cooperatively engaging said nose module and said tail module forming a peripheral interface joint coupling said nose module and said tail module to said intermediate module;

d) a tensioning member releasably connecting said forward module, said center module and said rear module in serial longitudinal alignment; and e) wherein said center module includes an axial passageway, each said forward module and said rear module including a borehole in axial alignment with said axial passageway, said tensioning member extending through each said borehole and said axial passageway operatively connected for applying a compressive force connecting said center module to said forward module and said rear module.

12. A modular floatation board, comprising:

a) a nose module having a longitudinal axis;

b) a tail module having a longitudinal axis;

c) an intermediate module having a longitudinal axis, wherein said intermediate module is disposed between said nose module and said tail module, said intermediate module including a longitudinal dimension and a transverse dimension, wherein said longitudinal dimension is greater than said transverse dimension;

d) said intermediate module including a peripheral interface cooperatively engaging said nose module and said tail module forming a peripheral interface joint coupling said nose module and said tail module to said intermediate module;

e) a tensioning member releasably coupling said intermediate module to said nose module and said tail module in longitudinal alignment; and f) wherein said peripheral interface is defined by a circumferential rib projecting radially outwardly from said intermediate module, and wherein each said nose module and said tail include a semi-circumferential groove for interface connection with said circumferential rib of said intermediate module.

* * * * *